US005349427A

United States Patent [19]

Benedict et al.

[11] Patent Number: 5,349,427

[45] Date of Patent: Sep. 20, 1994

[54] REPRODUCTION MACHINE WASTE IMAGING MATERIALS REMOVAL SYSTEM

[75] Inventors: Lawrence R. Benedict, Rushville; Raymond C. Bassett, Webster; Thomas C. Fowler, Rochester, all of N.Y.

[73] Assignee: Xerox Corporation, Stamford, Conn.

[21] Appl. No.: 165,791

[22] Filed: Dec. 13, 1993

[51] Int. Cl.[5] ..... G03G 21/00

[52] U.S. Cl. ..... 355/298; 355/260; 222/DIG. 1

[58] Field of Search ..... 355/260, 298; 118/652, 118/653; 222/DIG. 1

[56] References Cited

U.S. PATENT DOCUMENTS

| | | | |
|---|---|---|---|
| 5,260,75 | 11/1993 | Imaizumi | 355/298 |
| 4,062,385 | 12/1977 | Katusha | 141/89 |
| 4,848,267 | 7/1989 | Slayton et al. | 222/DIG. 1 |
| 4,849,791 | 7/1989 | Hagihara et al. | 355/260 X |
| 4,860,056 | 8/1989 | Kano et al. | 355/298 |
| 4,862,226 | 8/1989 | Imaizumi et al. | 355/298 |
| 4,982,231 | 1/1991 | Matsuuchi | 355/298 X |
| 4,997,016 | 3/1991 | Hacknauer et al. | 222/DIG. 1 |
| 5,074,344 | 12/1991 | Vacek et al. | 355/260 X |
| 5,089,854 | 2/1992 | Kaieda et al. | 355/260 |
| 5,132,740 | 7/1992 | Okamoto et al. | 355/298 |
| 5,303,008 | 4/1994 | Kalyandurg et al. | 355/260 X |
| 5,309,208 | 5/1994 | Bean et al. | 355/260 |

*Primary Examiner*—R. L. Moses

[57] ABSTRACT

A sealed system for collecting and removing waste imaging material from a reproduction apparatus in a waste collection container removably insertable into the reproduction apparatus so that the inlet opening of the container is positioned at discharge outlet of a pneumatic cleaning system, especially, the outlet of a cyclone air/toner separator. The container has a dual mode resilient pneumatic seal surrounding its inlet, and an integral insertion guide member. The cleaning system discharge outlet includes a spring loaded sled member and a flexible pneumatic seal connecting between the sled member and the discharge outlet to allow limited movement of the sled member. The insertion guide member of the container slides on an entrance guide path into compressed superposed engagement with the sled member to form a pneumaticaly-sealed waste material path between the discharge outlet of the reproduction apparatus cleaning system and the interior of the waste container when so inserted. Also provided is a cap for sealing the inlet opening of the container when the container is removed by engagement with the same, dual mode, resilient pneumatic seal surrounding the inlet opening of the container. Also, a mating detent system is provided, which also protects the seal.

8 Claims, 4 Drawing Sheets

REPRODUCTION MACHINE WASTE IMAGING MATERIALS REMOVAL SYSTEM

Cross-reference and incorporation by reference is made to a copending application by the same assignee, filed Sep. 8, 1993, as U.S. application Ser. No. 08/118,077, by John D. Sotack, et al, entitled "Capacitive Sensor".

The disclosed system provides for improved removal and handling of waste imaging material from a reproduction apparatus, such as the collection of the fine dry particulate toner collected by a pneumatic cleaning system of a xerographic copier or printer.

There is disclosed in the embodiment herein an improved system for the insertion and removal of a waste toner collection container with faster and easier operator handling and reduced opportunities for inadvertent leakage of the toner. In particular, there is disclosed an improved pneumatic sealing system that allows waste toner to be collected in an easily removable container even from a cleaning system operating under vacuum, such as the outlet of a cyclone separator, without significant air or toner leakage.

Some prior art systems have employed a "revolving door" type system with driven rotary vanes and an auger to dump waster toner into a container without losing the pneumatic sealing of the cleaning system, such as in the Xerox Corp. "4850" printer.

An example of a reproduction apparatus into which the exemplary embodiment waste material collection container may be removably mounted is the Xerox Corporation "4890" printer. Apparatus of this general type is disclosed in Xerox Corporation U.S. Pat. No. 5,144,369 issued Sep. 1, 1992 and other art cited therein.

Although the disclosed system relates to imaging material recovery and removal, not replenishment, by way of background re toner replenishment systems for reproduction machines is Eastman Kodak Co. U.S. Pat. No. 4,062,385 issued Dec. 13, 1977 to J. M. Katusha, et al.

A specific feature of the specific embodiment disclosed herein is to provide in a waste imaging material collection and removal system wherein waste imaging material from a reproduction apparatus is collected in a removable waste collection container, which waste imaging material collection container is removably insertable into the reproduction apparatus so that an inlet opening of said container is positioned at a waste imaging material discharge outlet of the reproduction apparatus; the improvement wherein said waste imaging material collection container has a resilient pneumatic seal surrounding said inlet opening of said container, said waste imaging material container also has an integral insertion guide member, said waste imaging material discharge outlet of the reproduction apparatus includes an entrance guide path and a spring loaded sled member and a pneumatic seal connecting between said sled member and said discharge outlet to allow limited movement of said sled member, said integral insertion guide member of said container being adapted to slide on said entrance guide path into compressed superposed engagement with said spring loaded sled member to form a pneumatic seal between said container and said sled member with said dual mode resilient pneumatic seal when said container is inserted into the reproduction apparatus, said sled member providing a pneumaticaly sealed waste material path between said discharge outlet of the reproduction apparatus and said inlet opening of said container when said insertion guide member is so inserted in the reproduction apparatus.

Further features disclosed in the system embodiment herein, individually or in combination, include a cap member for sealing the inlet opening of the container when the container is removed from the reproduction apparatus by engagement of the cap member with the same dual mode resilient pneumatic seal surrounding the inlet opening of the container; and/or wherein the waste imaging material discharge outlet is the bottom outlet of a vacuum system cyclone air/toner separator and the container is directly thereunder; and/or the waste imaging material collection container collects waste imaging material from the cyclone air/toner separator with the same vacuum being applied to the container without substantial air leakage; and/or wherein the seal connecting between the sled member and the discharge outlet is a foraminous hose section; and/or wherein the waste imaging material collection container integral insertion guide member slightly lifts the sled member; and/or wherein the waste imaging material collection container integral flange and the sled member have a mating detent system, detenting in a position substantially aligned with the discharge outlet.

As to specific hardware components of the subject apparatus, or alternatives therefor, it will be appreciated that, as is normally the case, some such specific hardware components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the examples below, as well as the claims. Thus, the present invention will be better understood from this description of this embodiment thereof, including the drawing figures (approximately to scale) wherein:

Figure 1:
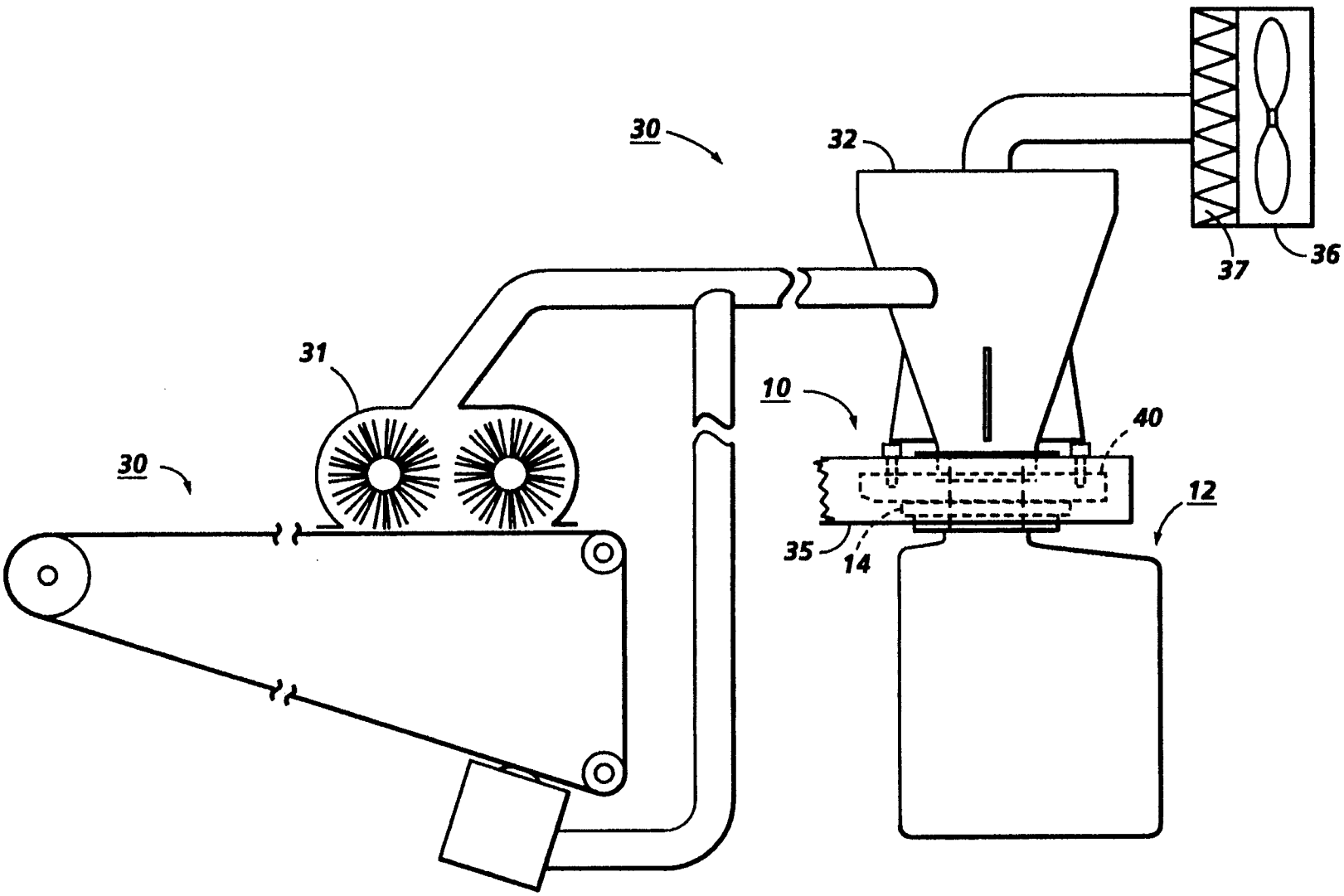
FIG. 1 is a side view of one example of a waste imaging material collection and removal system in accordance with the present invention.

Referring now to the Figures, it will be appreciated that since the exemplary waste imaging material collection and removal system 10 shown here may be utilized with any of various known conventional or new reproduction machines, that only those parts or components thereof which are modified for this exemplary system need be illustrated in FIG. 1. However, some associated components of an exemplary reproduction apparatus 30 vacuum cleaning system 31 are schematically illustrated in FIG. 1 in reduced scale.

As noted above, the present system is particularly desirable for providing an easy to insert and remove waste collection system for the untransferred particulate dry toner which is outputted from the pneumatic cleaning system (and the bead or agglomerates removal device, if any) of a xerographic copier or printer. The present system allows the waste toner to be neatly collected into a removable container 12 even though the cleaning system is of a vacuum type, without significant air or toner leakage. In the present system, the waste toner container 12 may be internally maintained at the same vacuum level as the cleaning system outlet to which it is connected.

Figure 2:
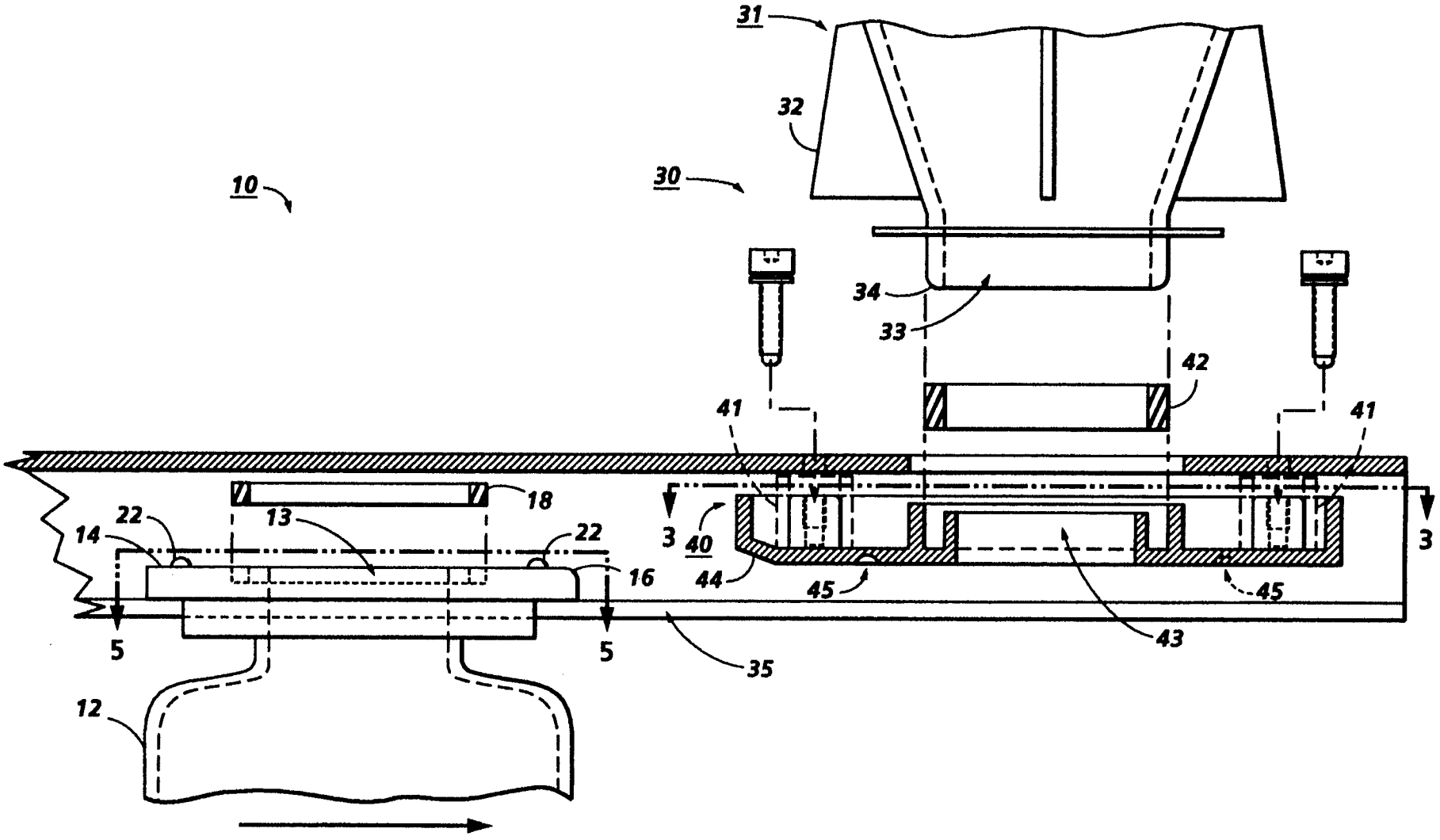
FIG. 2 is a partially exploded, more detailed side view of the waste imaging material collection system of FIG. 1.
Figure 3:
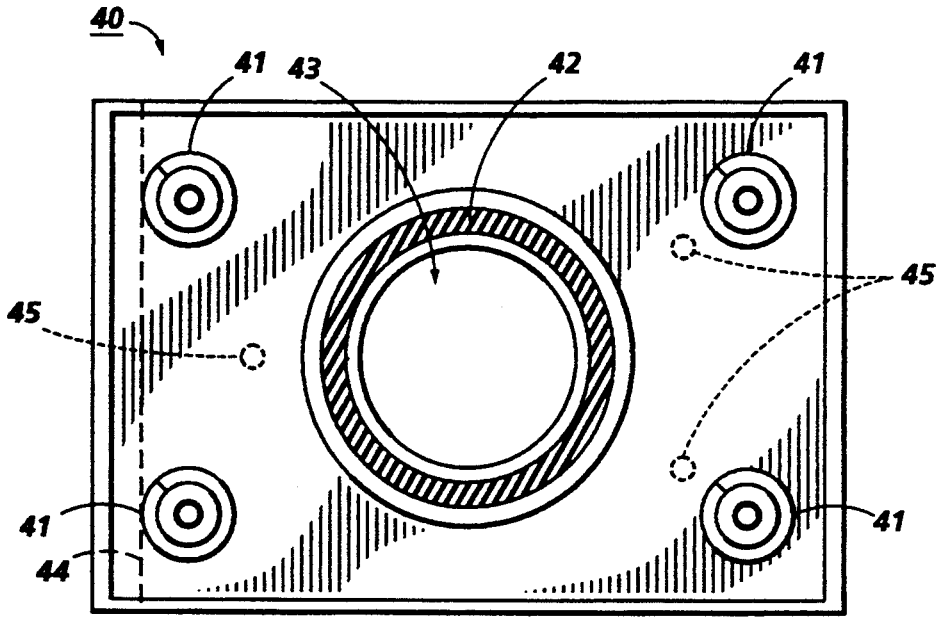
FIG. 3 is a top view of the sled component per se of the system of FIGS. 1 and 2 viewed along the line 3—3 of FIG. 2.

There is illustrated in FIGS. 1 and 2 the lower portion of a (well known per se) cyclone separator 32 with an outlet opening 33 at the bottom thereof through which, as the copier or printer 30 operates, waste toner form the cleaning system 31 is dropped by gravity through this cyclone separator 32 outlet opening 33 into the interior of the waste toner container 12 via its inlet 13. The waste toner container 12 is illustrated here as a relatively rigid plastic bottle, although it is appreciated that it may also comprise a semi-flexible bag, box, or other container, providing that the other features desired herein are provided therewith. Furthermore, the waste toner container 12 is desirable provided with a capacitive, weight, or other sensor to automatically indicate to the operator, by an operator display, that the container 12 is effectively full. That is, to indicate that the container 12 should be removed from the machine 30 and the lid 20 installed, and the waste toner therein properly disposed of, and an emptied or new waste toner container 12 replaced in the machine 30, as will be described. A suitable such sensor for detecting a full waste toner container 12 is disclosed in the above-referenced copending commonly assigned application.

Turning now to the unique waste toner container 12 here, it may be seen that at the level or plane of the inlet opening 13 thereof is a laterally extending flange 14. The leading edge of flange 14 has a rounded edge surface 16. Surrounding the inlet opening 13 is a dual mode seal 18, here a neoprene or other seal ring fitted into a slight annular recess in the flange 14 upper surface and projecting slightly above the upper surface of this flange 14. The seal 18 need only be stiffly resilient enough to resist substantial airflow leakage, which will depend on the particular vacuum level desired. It may be seen that the upper surface of the flange 14 is essentially otherwise planer, except for a pattern of three spaced detent bumps 22, the operation of which will be subsequently described. These bumps 22 project slightly above the upper surface of the flange 14 by approximately the same distance as the seal 18.

Turning now to further detail of the reproduction apparatus 30, the portion thereof illustrated in detail in FIG. 2 is the output portion of the vacuum cleaning system 31, in particular the lower portion of a cyclone separator 32. As shown schematically in FIG. 1, the cyclone separator 32 is connected to a blower 36 or other known vacuum source on one (air outlet) side of the cyclone separator 32, which may also include an additional porous paper filter 37, as shown. (Two blowers may be used instead of one.). The other (inlet) side of the cyclone separator 32 connects via air ducts with a rotating brush or other cleaning system for the photoreceptor of the reproduction apparatus 30. Vacuum waste pickup may also be connected as shown to a bead and agglomerates removal device, further illustrated in a commonly assigned U.S. application Ser. No. 08/084,697 entitled "VACUUM ASSISTED BEAD PICK OFF APPARATUS EMPLOYING A PLURAL LEVEL SURFACE - HYBRID AIR KNIFE", filed Jun. 29, 1993. The cyclone separator 32 has a bottom outlet opening 33.

This outlet opening 33 is surrounded by a lip 34 which flexibly connects to a sled member 40 by a seal 42. The sled 40 has an aligned opening 43 therethrough. The sled member 40 is a generally planer plate which is mounted for limited vertical movement (but not horizontal movement) by four shoulder screws in the four corners, and spring loaded away by springs 41 from the outlet opening 33 lip 34. A flexible seal 42 in the form of an annular ring or hose, such as a foam rubber hose of approximately 4 mm wall thickness, is connecting between the outlet lip 34 and the sled member 40 to provide a flexible but airtight seal therebetween. The upper portion of the seal 42 may be held around the outside of the lip 34. Thus, the waste toner which is captured in the cyclone separator 32 conventionally drops to the bottom of the cyclone separator and then passes out through the outlet opening 33 thereof past seal 42 and through the mating discharge path or opening 43 in the sled member 40 and then past seal 18 into opening 13 into container 12, when the reproduction apparatus 30 is operating.

Describing now the system by which the waste toner container 12 is inserted into the machine 30 and placed in an airtight or pneumatic seal connection with the vacuum cleaning system 31, this is provided by sliding the container 12 into the reproduction apparatus 30 on an entrance guide path rails 35, here comprising two parallel supporting and sliding rails for the bottom of the flange 14. The flange 14 slides the container 12 into the machine 30 on rails 35 until the leading edge 16 reaches a ramp lip 44 on the sled member 40. As the container 12 continues to be inserted by the operator, the flange 14 continues to slide underneath the sled member 40 and the detent bumps 22 now engage and raise the sled member 40 up against the force of the four compression springs 41. The raised detent bumps 22 thus help protect the seal 18 from lateral force during this continued insertion.

After the container 12 and its integral flange 14 have been so fully inserted into the reproduction apparatus 30, the detent bumps 22 engage and move into correspondingly positioned detent recesses 45 in the bottom of sled member 40, and thereby the sled 40 moves down slightly to press against seal 18. Thus, the waste toner container 12 is now in its proper inserted position for receiving waste toner therein by direct communication with the cyclone separator 32 through its outlet opening 33 and sled opening 43 to the now-aligned container entrance opening 13. In this operating position, the dual mode seal 18 is forcibly engaged by the bottom surface of the sled member 40, pressing against it to form a pneumatic seal with the container 12 interior. The seal 42 meanwhile maintains a seal between the sled 40 and the cyclone separator 32.

When the waste toner container 12 is full, as described above, the above-described movement of the container 12 is reversed to take it out of the reproduction apparatus. The waste toner container 12 cannot be inadvertently spilled by the operator during its removal from the reproduction apparatus 30 because it is being held upside down on the guide path rails 35 throughout its entire removal process.

Figure 4:
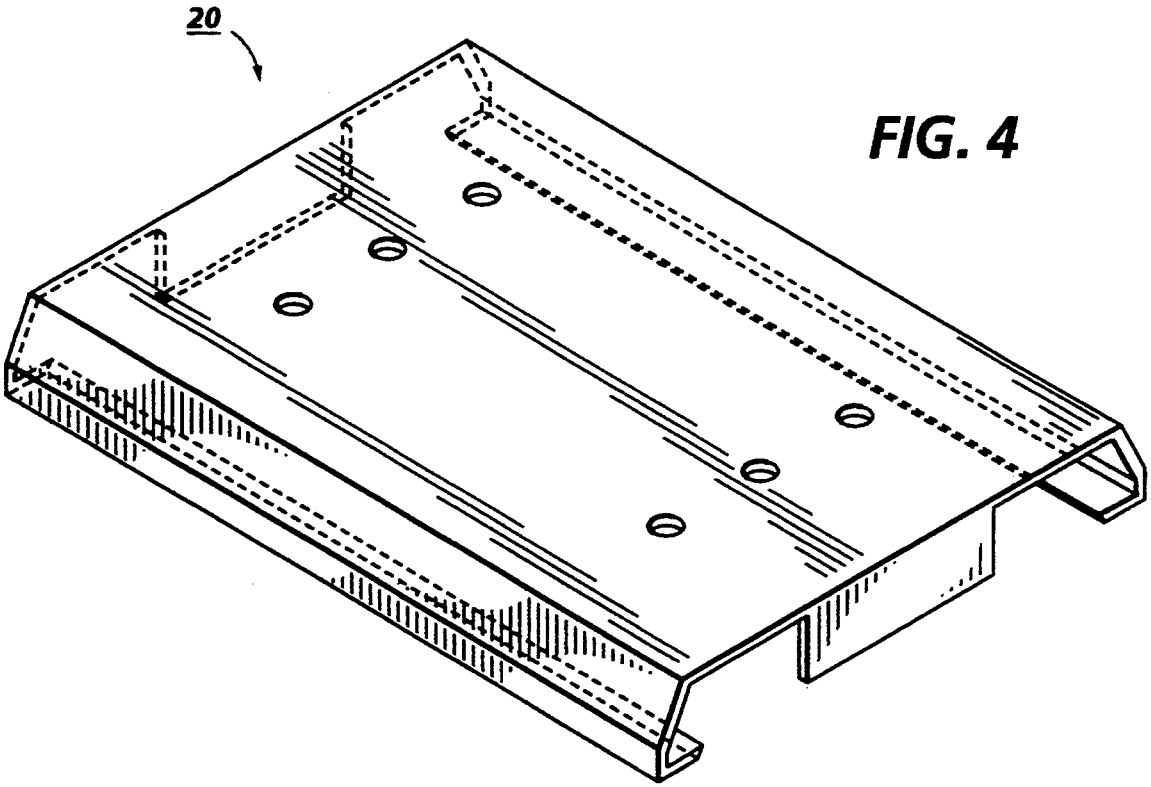
FIG. 4 is a perspective view of one example of a snap-on lid for the waste imaging material collection container of FIGS. 1 and 2.
Figure 5:
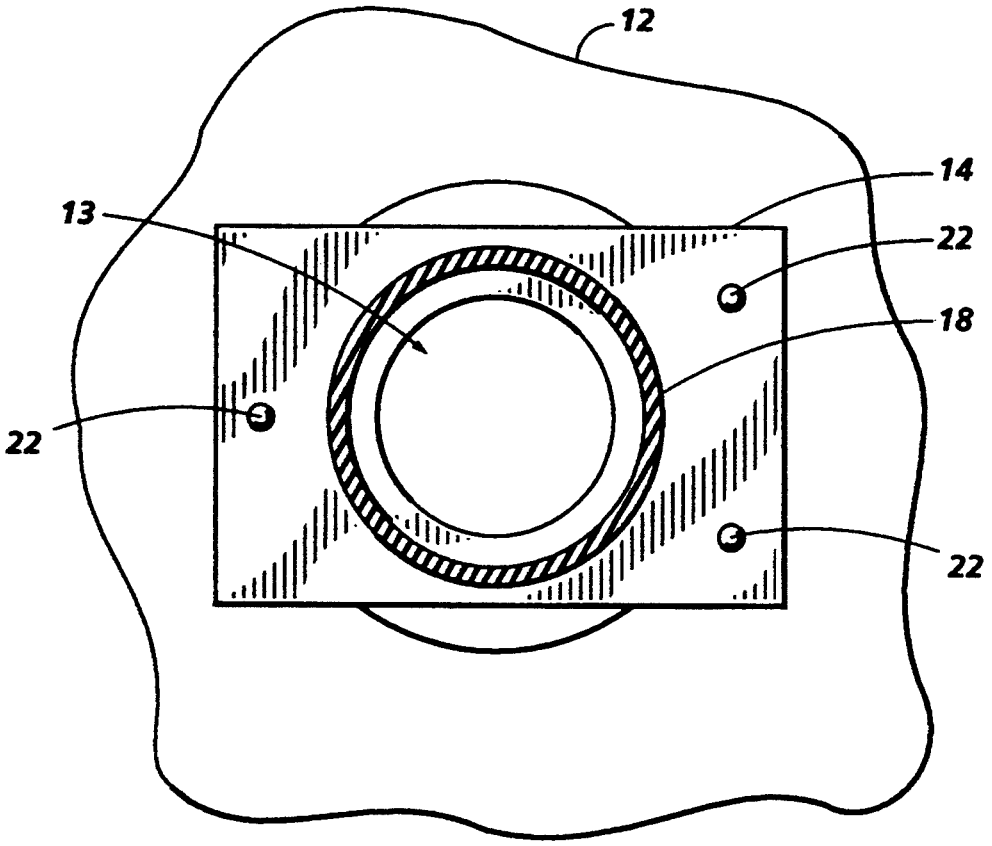
FIG. 5 is a top view of the waste container per se, with its integral flange, of the system of FIGS. 1 and 2.

Once the container 12 is removed, it is desirably manually covered by the operator with a removable cap or lid such as 20, shown in FIG. 4. The lid 20 preferably snaps over the container 12 inlet 13 so as to sealably engage with the same dual mode seal 18. Six holes are provided in the lid 20, as shown, for clearance for the three detents 22, in either position. I.e., the cover 12 may be rotated 180 degrees and still tightly fit. Thus, the seal 18 serves to provide a toner leakage seal between the container 12 interior opening 13 and the overlying cap or lid 20. This is the same seal 18 which seals the container 12 interior to the vacuum cleaning system 31 when it is inserted in the reproduction apparatus 30, as described above. Thus, this dual-mode sealing system provides a leak-free vacuum system in operation as well as a leak proof container after removal. Yet relatively low operator insertion and removal forces are required by the operator.

While the embodiment disclosed herein is preferred, it will be appreciated from this teaching that various alternatives, modifications, variations or improvements therein may be made by those skilled in the art, which are intended to be encompassed by the following claims.

What is claimed is:

1. In an waste imaging material collection and removal system wherein waste imaging material from a reproduction apparatus is collected in a removable waste collection container, which waste imaging material collection container is removably insertable into the reproduction apparatus so that an inlet opening of said container is positioned at a waste imaging material discharge outlet of the reproduction apparatus; the improvement wherein:

said waste imaging material collection container has a resilient pneumatic seal surrounding said inlet opening of said container;

said waste imaging material container also has an integral insertion guide member;

said waste imaging material discharge outlet of the reproduction apparatus includes an entrance guide path and a spring loaded sled member and a second pneumatic seal connecting between said sled member and said discharge outlet to allow limited movement of said sled member;

said integral insertion guide member of said container being adapted to slide on said entrance guide path into compressed superposed engagement with said spring loaded sled member to form a pneumatic seal between said container and said sled member with said resilient pneumatic seal when said container is inserted into the reproduction apparatus;

said sled member providing a pneumaticaly sealed waste material path between said discharge outlet of the reproduction apparatus and said inlet opening of said container when said insertion guide member is so inserted in the reproduction apparatus.

2. The waste imaging material collection and removal system of claim 1, further including a cap member for sealing said inlet opening of said container when said container is removed from the reproduction apparatus by engagement of said cap member with said same resilient pneumatic seal surrounding said inlet opening of said container.

3. The waste imaging material collection and removal system of claim 1, wherein said waste imaging material discharge outlet is the bottom outlet of a vacuum system cyclone air/toner separator, and said waste imaging material collection container collects waste imaging material from said cyclone air/toner separator with a vacuum being applied to said container without substantial air leakage.

4. The waste imaging material collection and removal system of claim 1, wherein said second pneumatic seal connecting between said sled member and said discharge outlet is a foraminous hose section.

5. The waste imaging material collection and removal system of claim 1, wherein said waste imaging material collection container integral insertion guide member includes a leading edge ramp surface for slightly lifting said sled member with said insertion guide member.

6. The waste imaging material collection and removal system of claim 1, wherein said waste imaging material collection container integral insertion guide member and said sled member have a mating detent system for removably retaining said container in an operative position substantially aligned with said discharge outlet.

7. The waste imaging material collection and removal system of claim 6, wherein said detent system includes raised detent elements on said insertion guide member also functioning to protect said resilient pneumatic seal during said insertion.

8. The waste imaging-material collection and removal system of claim 3 wherein said waste imaging material collection container is positionable directly underlying said cyclone air/toner separator.

* * * * *